US005117940A

United States Patent [19]

Garelick

[11] Patent Number: 5,117,940

[45] Date of Patent: Jun. 2, 1992

[54] SWINGABLE BOAT LADDER

[75] Inventor: Richard J. Garelick, Minneapolis, Minn.

[73] Assignee: Garelick Mfg. Co., St. Paul Park, Minn.

[21] Appl. No.: 788,740

[22] Filed: Nov. 7, 1991

[51] Int. Cl.[5] ..... E06C 5/04; B63B 29/20

[52] U.S. Cl. ..... 182/97; 182/20; 182/91; 114/362; 280/166

[58] Field of Search ..... 182/97, 91, 20, 21; 114/362; 280/166

[56] References Cited

U.S. PATENT DOCUMENTS

| | | | |
|---|---|---|---|
| 2,037,805 | 4/1936 | Lindstedt | 182/97 |
| 2,059,240 | 11/1936 | Johnston | 182/20 |
| 2,657,940 | 11/1953 | Davidson | 182/97 |
| 2,971,601 | 2/1961 | Fortune | 182/97 |
| 3,190,392 | 6/1965 | Ashston | 182/97 |
| 3,313,374 | 4/1967 | Teach | 182/97 |
| 3,539,033 | 11/1970 | Schwarz | 182/97 |
| 3,656,578 | 4/1972 | Hemken | 182/20 |
| 4,846,303 | 7/1989 | Cooper | 114/362 |

*Primary Examiner*—Reinaldo P. Machado
*Attorney, Agent, or Firm*—Jacobson and Johnson

[57] ABSTRACT

One end of a leg of a boat ladder is swivably and pivotably affixed to the side of a boat and the corresponding end of the other leg of the ladder is releasably latched or hooked to one of a pair of brackets located on the same side of the boat forward and aft of the affixed attachment. The ladder is stored in a vertically upright position with the second leg latched onto one of the pair of brackets. To be put to use the second leg first is unhooked from the bracket and swung outward in a generally horizontal arc of about 180 degrees until it reaches the other of the pair of brackets and is then latched or hooked onto the other of the pair of brackets and then the ladder is swung vertically outward and downward toward or into the water. Standoffs may be provided on each leg of the ladder to support the ladder against and away from the side of the boat or the "logs" or floats of a pontoon boat.

4 Claims, 7 Drawing Sheets 10
50
12
13
11
51
20
20
13
13
18A
14
15
18B
16

30
30
11
26
27
15
26
18A,
18B
22
28
28
24
24
29
29
25
23
25
23

36
15
14
33
37
40
39
38
35
41
41
42
43
39
34
45
8
8
12

SWINGABLE BOAT LADDER

FIELD OF THE INVENTION

This invention is directed toward the general field of boat ladders for pleasure boats. More specifically, it is directed toward a boat ladder which is permanently attached to the side of a pleasure boat and which can be placed in an elevated upright position for storage or can be swung out and down toward or into the water for use in getting in and out of the boat. The ladder is particularly useful on pontoon boats.

DESCRIPTION OF THE PRIOR ART

Typically, ladders used for climbing into and out of pleasure craft or boats were lowered down into or toward the water and hooked onto the side or an edge of the boat. When not in use the ladder was lifted off the side or edge and stored away somewhere. Sometimes the ladder would be misplaced and then the user would have to search high and low to find it. Other times the user would forget to remove the ladder and it would be dragged along as the ship or boat was moving which could cause it to fall off or be damaged or damage the boat. Also, hooking and unhooking the ladder on the side or edge of the boat may scratch the paint or otherwise mar the appearance of the boat. Also, it is necessary to get on one's hands and knees or at least bend over steeply at the waist in order to hook the boat ladder onto the side or edge of the boat and to remove it. This can be particularly irksome to some individuals.

SUMMARY OF THE INVENTION

The ladder of this invention has a conventional shape, i.e., it has two vertical, spaced-apart, rigid side legs and a plurality of horizontal, spaced-apart parallel rungs attached at each end in a conventional fashion to each side leg. One end of one leg of the ladder is swivably and pivotably affixed to a side of the boat so that the one leg of the ladder is permanently attached to the side of the boat. When upright the ladder can be swung or swiveled in a general horizontal arc of about 180 degrees and then can be swung from an upright to a lowered position (and back again) in a general vertical arc of about 180 degrees from the side of the boat. In use the upright ladder is swiveled out of its stored location into its use location and then swung downward or towards the water. After use it is swung upward against the boat and then swiveled about one leg back to its stored position. One leg of the ladder always remains attached to the boat. The corresponding end of the other leg of the ladder is removably latched or hooked onto one of two brackets attached to the side of the boat forward and aft of the pivotable and swivable permanent attachment. When latched or hooked to one of the brackets the ladder is held in an upright generally vertical position for storage. When latched or hooked onto the other bracket the ladder can be swung generally vertically downward for use in getting in and out of the boat and swung out of the water when not in use. The preferred hooking or latching arrangement comprises a cross-pin in the one leg of the ladder which engages a slot in an arm of the bracket which extends outward from the side of the boat. In the stored position the cross pin rests in the slot of one of the brackets with the ladder extending generally vertically upward. For lowering the ladder, the one leg is raised slightly to disengage the pin from the slot and the ladder is then swung or swiveled in a generally horizontal arc about 180 degrees and the cross-pin in the one leg is then inserted into an identical slot in the other bracket. The ladder is then swung outward and downward generally vertically toward or into the water. After use and to store away the ladder, the operation is reversed. It can be seen, then, that it takes relatively little effort to place the ladder from the stored position to the use position although, absent some added convenience feature, it may be necessary to get on the hands and knees or bend steeply from the waist to raise the ladder up from the lowered position. However, the ladder is always attached to the side of the boat so it cannot be misplaced, it is stored in a convenient location ready for use and there is no danger of dropping it into the water when it is being lowered or raised.

As an additional feature, standoffs are provided on the ladder legs to support the ladder against and space the ladder away from the side of the boat and/or any "logs" or barrels or floats used on a pontoon boat.

DESCRIPTION OF THE PREFERRED EMBODIMENT

Figure 2:
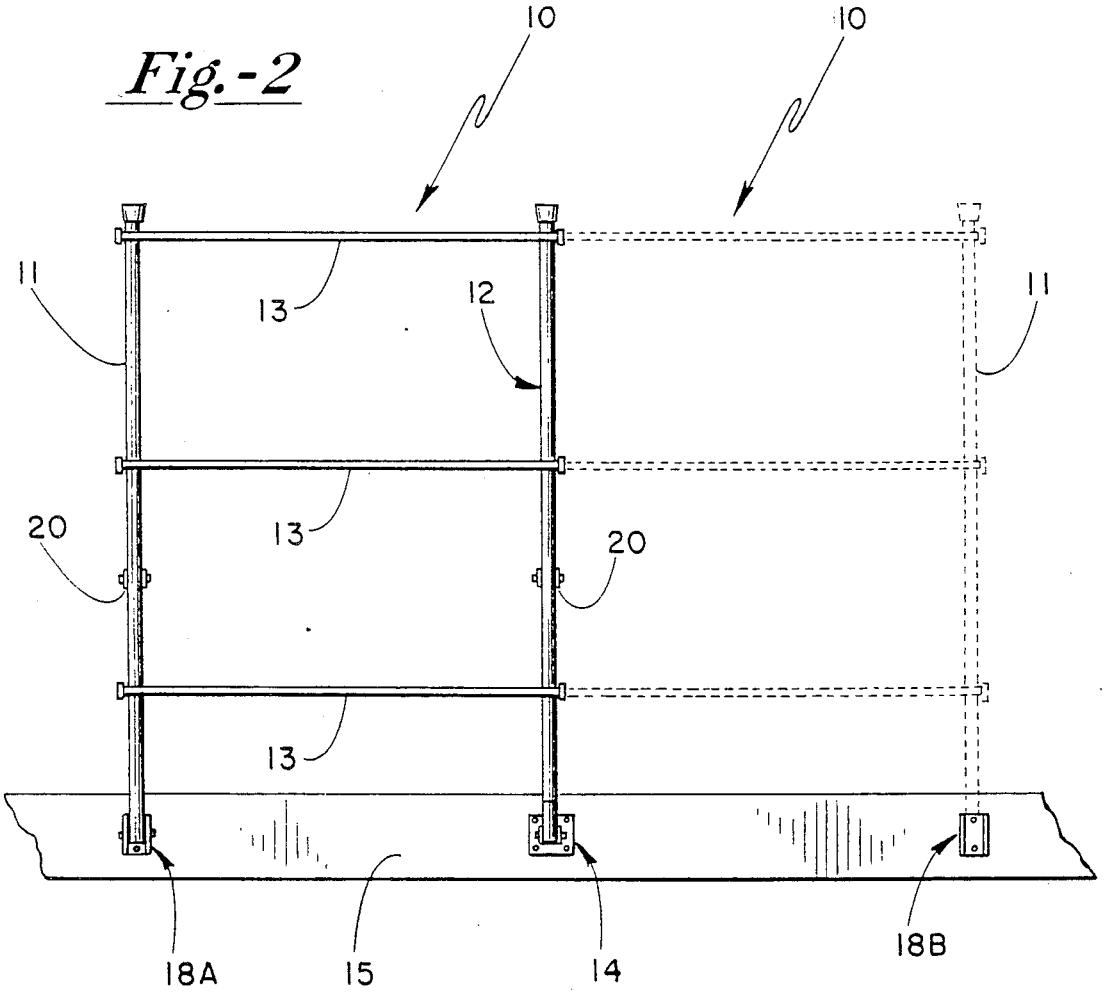
FIGS. 2 and 3 are side plan views illustrating the boat ladder as it is moved from its elevated stored position to its lowered use position.
Figure 3:
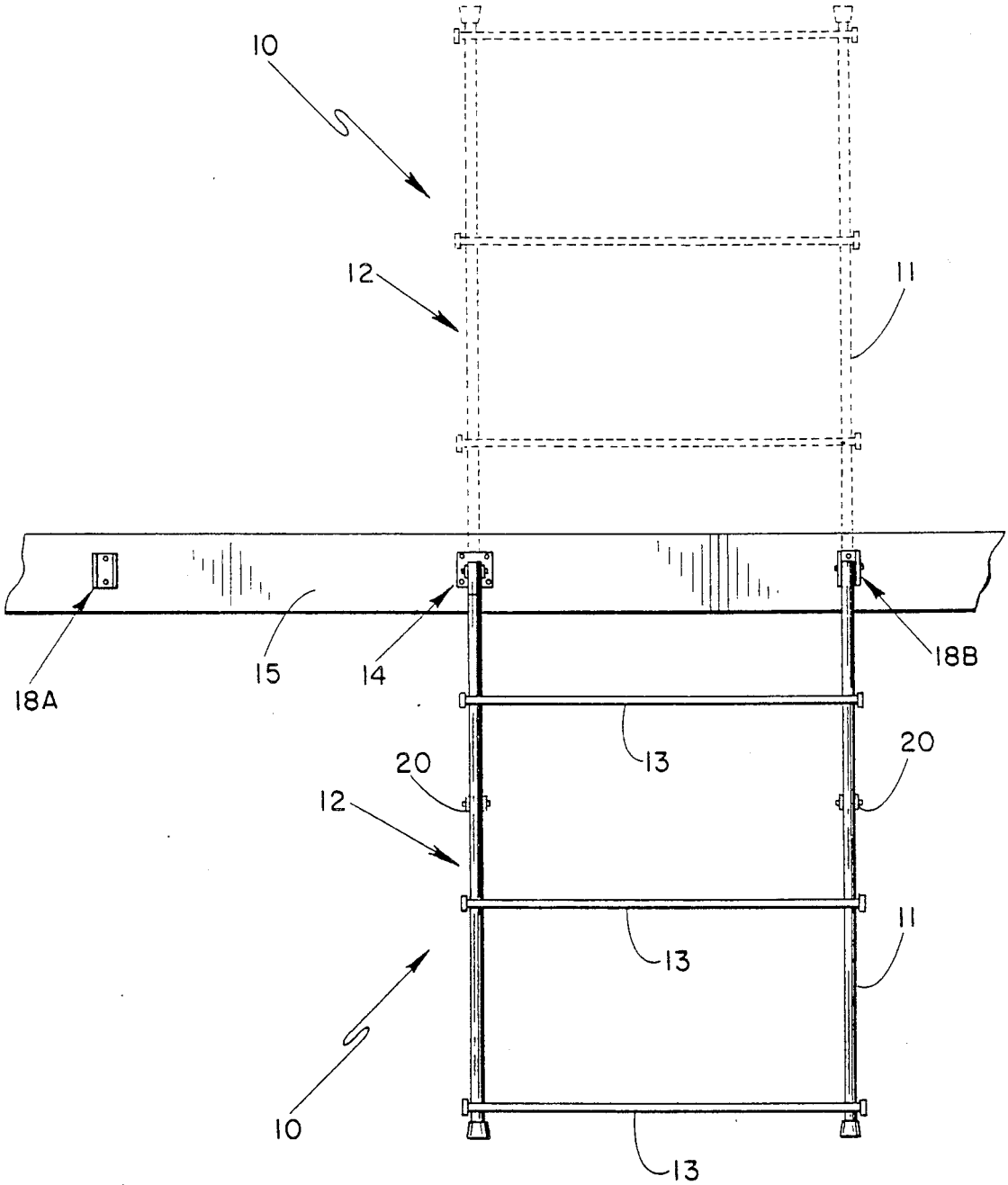

Ladder 10 conventionally has a pair of parallel rigid, tubular, usually hollow aluminum, vertical side legs 11 and 12 and a set of spaced-apart, parallel, horizontal rungs 13 attached at each end in some conventional fashion to legs 11 and 12. One end of leg 12 is affixed, in a manner which will be shown later in greater detail, to a first bracket 14 which is attached outboard to trimedge 15 along a side of the deck of a boat. For purposes of illustration, the invention is shown as used on a pontoon boat which has "logs" or barrels or floats 16 which provide the buoyancy support. At a distance generally equal to the width of the ladder, i.e., the distance between legs 11 and 12, a second bracket 18A is attached to the trimedge 15 of the boat. For illustrative purposes bracket 18A will be considered to be located forward of bracket 14. It is also at about the same elevation. A third bracket, 18B, which is identical to bracket 18A, is attached to trimedge 15 at the same elevation as the other two brackets aft of bracket 14 at a distance equal to the ladder width. In FIG. 2, ladder 10 is shown in solid line in its stored condition extending upward generally vertical along the side of the boat at railing 50 supported by brackets 14 and 18A and is shown in an intermediate position, at railing opening 51, by dashed or shadow lines in FIGS. 2 and 3, supported by brackets 14 and 18B. In the use or lowered position, as shown in solid line in FIG. 3, ladder 10 extends generally vertically downward at the side of the boat supported by brackets 14 and 18B. Preferably standoff arms 20 are attached in some convenient fashion to the inboard side of legs 12 and 11 so when the ladder is in use extending downward into or toward the water, the distal ends of standoffs 20 rest against the pontoon logs or floats 16 for support and for spacing the ladder away from the side of the boat and the floats. Preferably, standoff arms 20 are located on legs 12 and 11 so that when the ladder is in use, the standoff arms rest against floats 16 just slightly below their horizontal center line. Preferably the distal ends of standoff arms 20 are covered with a plastic tip, not shown, so that they don't damage the pontoon floats or the side of the boat. Also, preferably standoff arms 20 are foldable or collapsible so when not in use can be folded up against legs 11 and 12 when the ladder is in the stored position.

Figure 4:
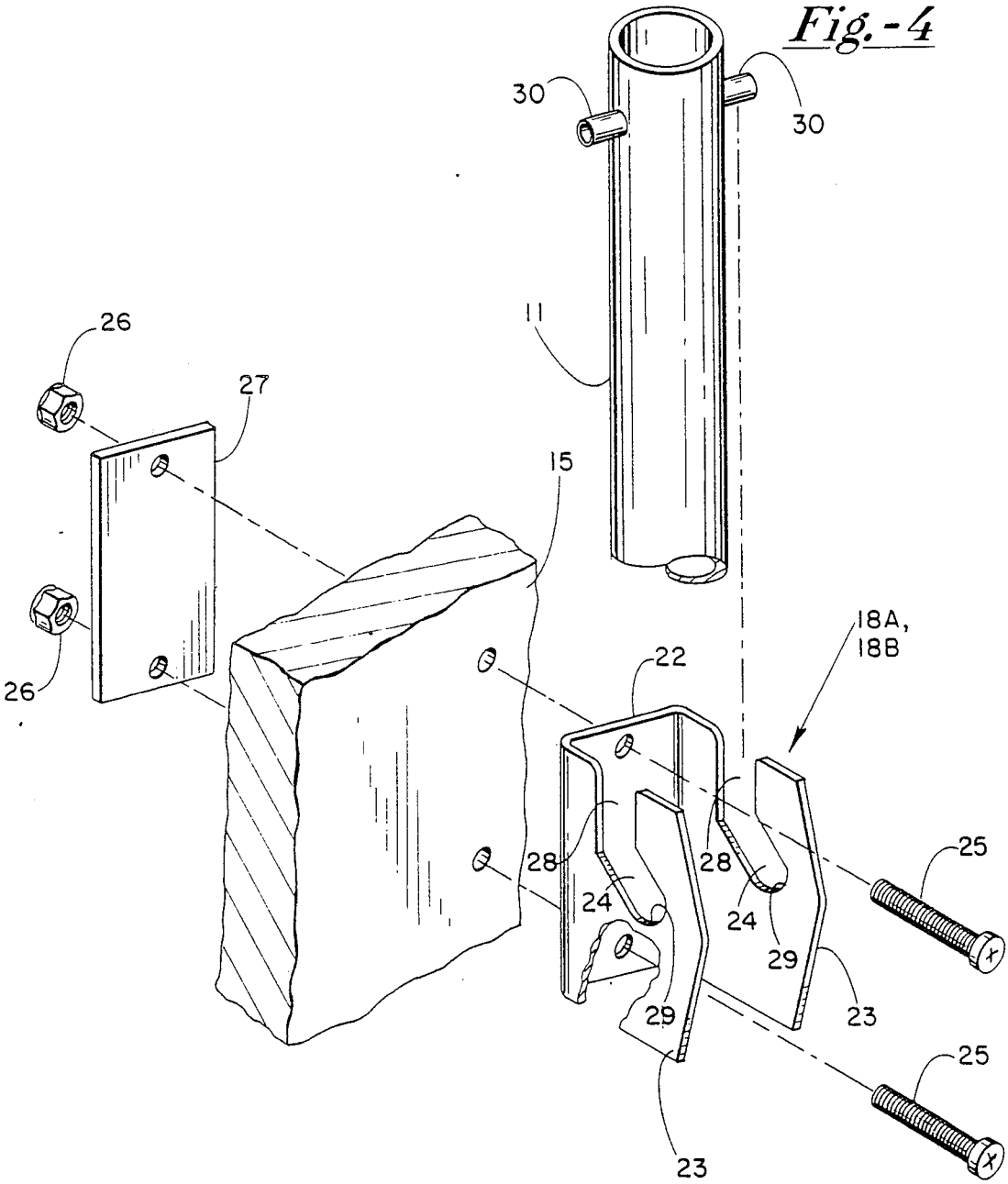
FIG. 4 is a blown-apart expanded perspective view illustrating a removable hooking attachment for one of the boat ladder legs.
Figure 5:
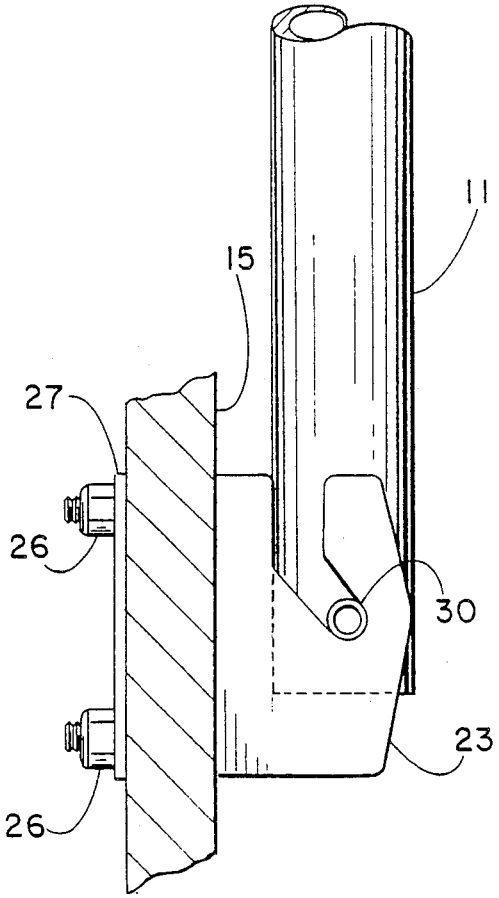
FIG. 5 is a vertical plan view showing the boat ladder leg hooked in place when in the upright position.
Figure 6:
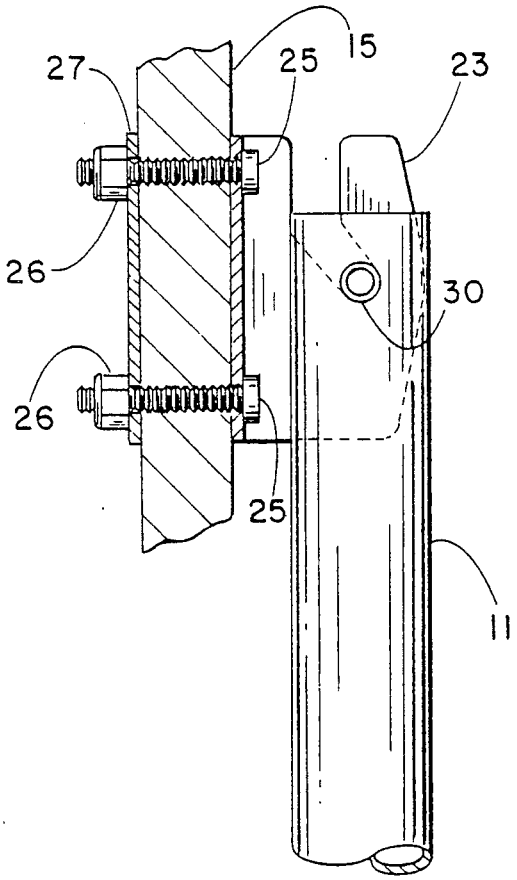
FIG. 6 is a vertical plan view showing the boat ladder leg hooked in place when in the lowered position.

Brackets 18A and 18B are identical to one another and, as seen most clearly in FIG. 4, have a flat rigid base plate 22, preferably made out of some durable metal, which is attached, usually by screws 25 and nuts 26, to trimedge 15. Preferably a rigid metal backing plate 27 is placed behind trimedge 15 to provide a more secure attachment. Extending outward from base plate 22 are a pair of parallel spaced-apart rigid arms 23 which may be attached along one edge to base plate 22 by welding or may be press formed integrally with plate 22 to form a U-shaped bracket. Arms 23 have parallel slots 24 which are open at their upper ends 28 and closed at their other ends 29. A cross-pin or roll pin 30 inserted through tubular ladder leg 11 close to one end of the leg to engage slots 24 by slipping through open ends 28 and rest against closed ends 29 with leg 11 between the two side arms 23. Preferably slots 24 are, in part, angled outward and downward so that when roll pin 30 is slipped into slots 24 it will be securely hooked in place. To release, leg 11 is moved slightly inward and raised upward until pin 30 disengages from slots 24.

Figure 7:
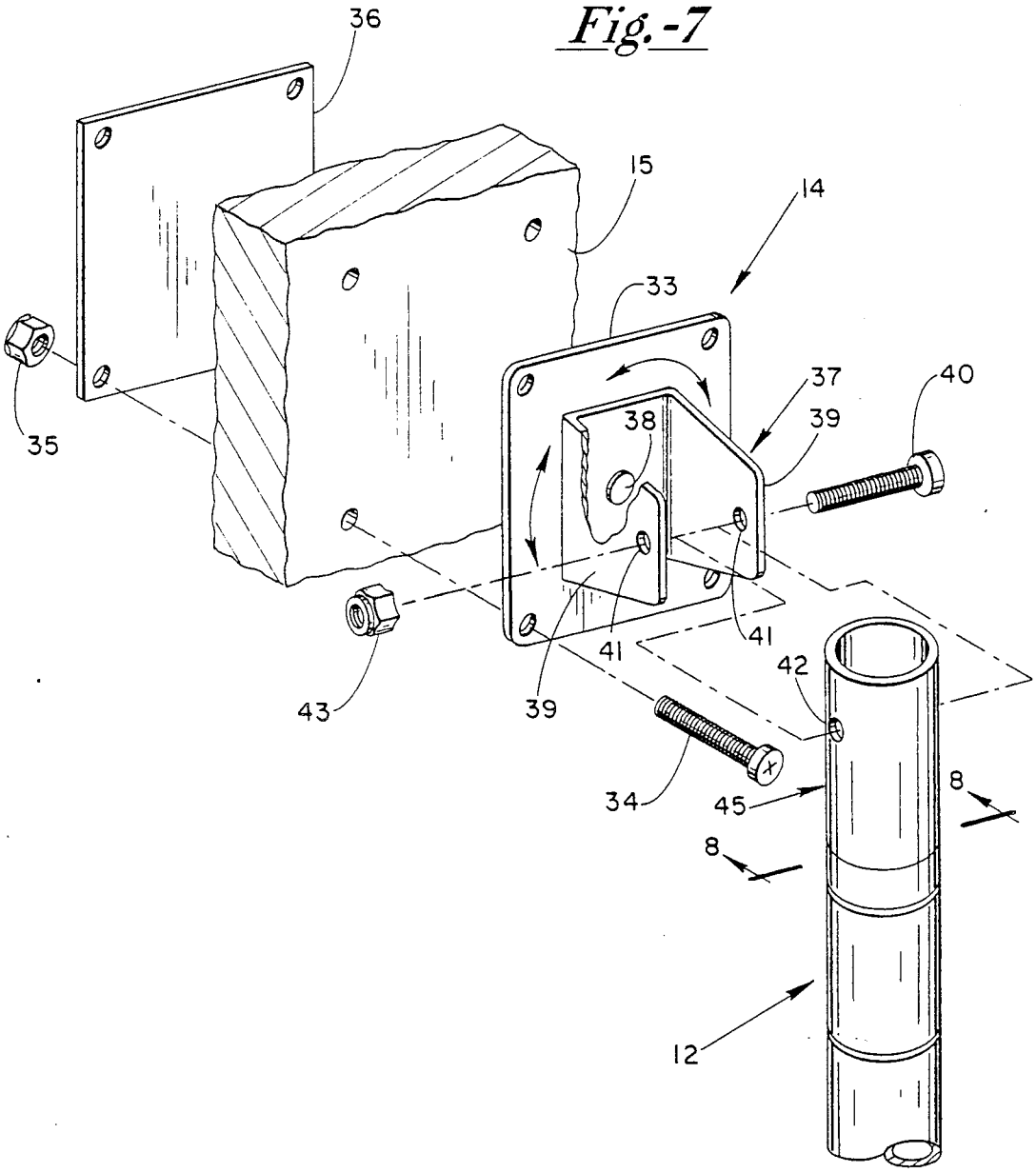
FIG. 7 is a blown-apart expanded perspective view illustrating means for attaching the other ladder leg to the side of a boat.

Referring next to FIG. 7, bracket 14 has a flat rigid metal base 33 which is attached to boat trim edge 15 by a set of four screws 34 and their mating nuts 35. Preferably a rigid metal flat backing plate 36 is placed behind trim edge 15 to provide a more secure attachment. A U-shaped or channel-shaped leg mount 37 is attached to the outside surface of base plate 33 by a rivet or pin 38 so that the two outwardly-extending spaced-apart parallel arms 39 of leg mount 37 can rotate or swivel with respect to base plate 33 as illustrated by the arrows. The reason for this arrangement will become apparent later. Near one of its ends, boat ladder leg 12 rests between arms 39 of mount 37 and is attached by screw or pin 40 inserted through openings 41 in arms 39 and through corresponding openings 42 (only one shown) in hollow leg 12. Screw 40 is secured in place by a nut 43. This attachment of leg 12 is made loose enough so that even though it affixes leg 12 to bracket 14 between arms 39, leg 12 is free to swing or pivot generally vertically about screw 40.

Figure 8:
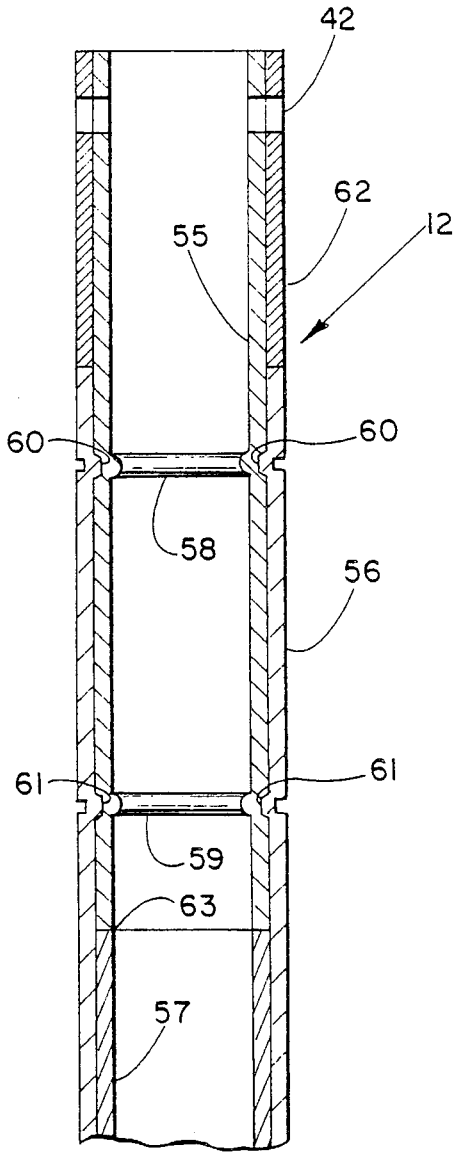
FIG. 8 is a vertical, partly-sectioned view showing the assembled attachment shown in FIG. 7.

In addition to the pivotable attachment of the end of leg 12 to bracket 14 via screw 40 and the rotatable attachment via pin 38, as described above, the end of leg 12 generally designated by reference numeral 45 is swivably attached to leg 12. FIG. 8 is a sectional view showing in detail the swivel attachment for leg 12. A first piece of hollow metal tube 55, preferably aluminum, is inserted into the outer hollow metal tubing 56 of leg 12 through one open end. Another piece of hollow tubing 57 is inserted inside tubing 56 from the other end and abuts end-to-end with tubing 55 in the interior of tubing 56 at 63 to provide some reinforcement for leg 12. Tubing 55 has a pair of parallel spaced-apart outer annular grooves 58 and 59 and the interior of tubing 56 has corresponding inwardly projecting annular depressions 60 and 61 which slidably mate with or engage the corresponding grooves 58 and 59 to prevent tubes 55 and 56 from moving longitudinally or axially with respect to one another yet allowing the two tubes 55 and 56 to rotate or swivel about a common axis with respect to one another. Another short length or stub of hollow tubing 62 covers over the part of tubing 55 which extends past the end of tubing 56. Tubing 62 is crimped or in some other fashion snugly secured to tubing 55. Cross openings 42 for receiving pin or bolt 40 (FIG. 7) are drilled or otherwise formed through tubing sections 55 and 62 in some suitable fashion. It can be observed then that when the end of leg 12 is attached to bracket 14, as described earlier with reference to FIG. 7, leg 12 can swivel about its axis and can be swung about an axis defined by pin or bolt 40 while affixed to bracket 14.

Figure 9:
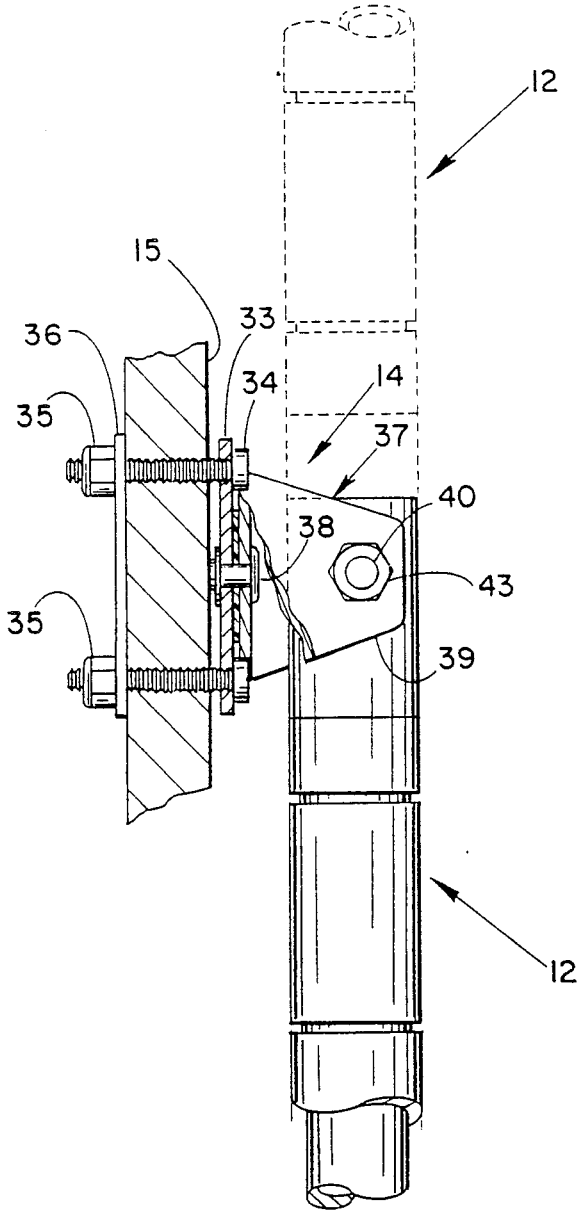
FIG. 9 is a vertical cross-section view showing the swivel attachment at one end of the ladder leg.

FIG. 9 illustrates in partial vertical section the attachment of leg 12 to bracket 14. Leg 12 is shown in solid line in the down position and shown in dashed or dotted line in the upright position. As illustrated in FIG. 9, a plastic washer 65 may be inserted between leg mount 37 and plate 33 to make it easier for the former to rotate with respect to the latter.

Figure 1:
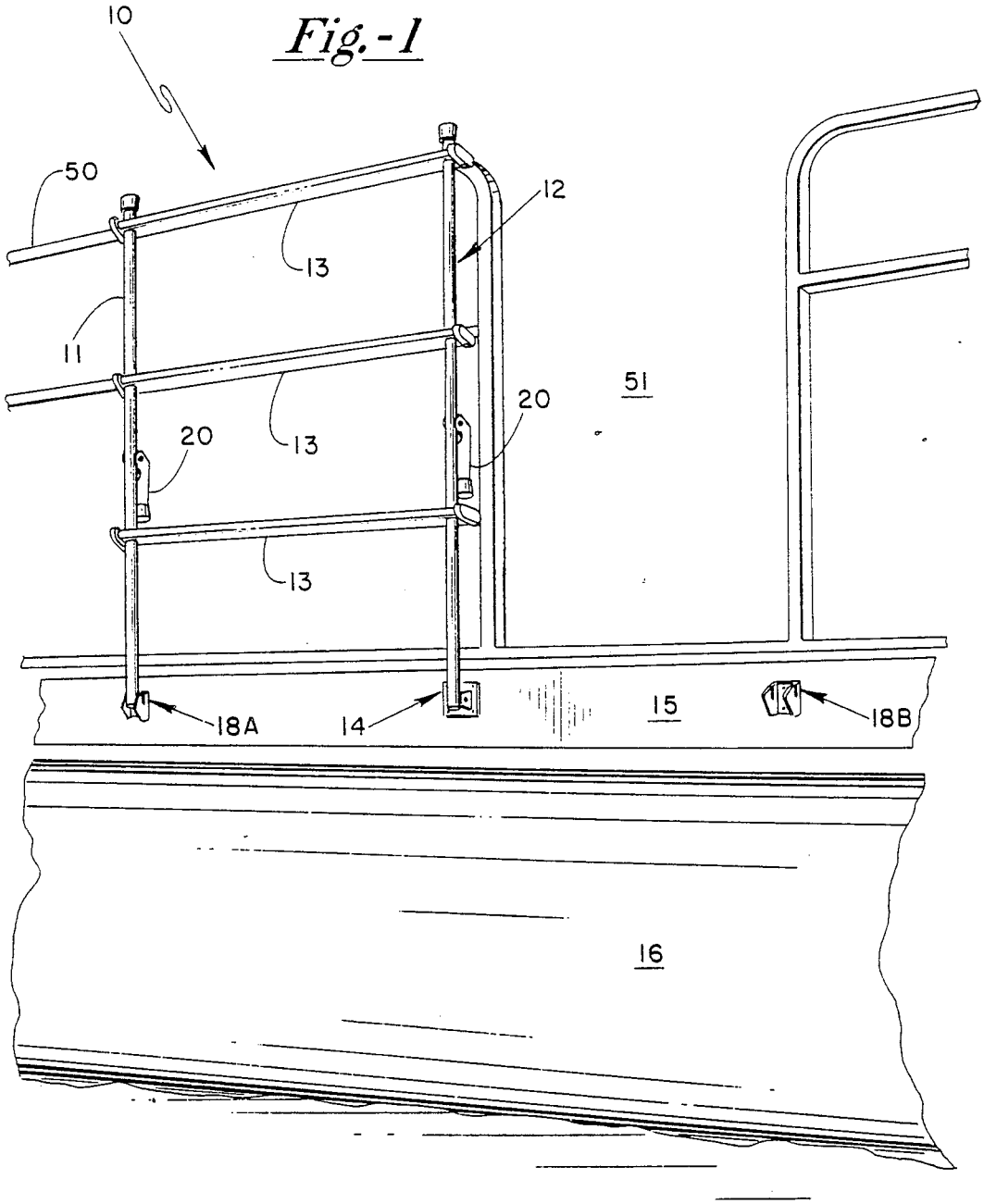
FIG. 1 is a perspective view of a preferred embodiment of the invention showing the boat ladder in the elevated stored position.

Prior to use, ladder 10 is normally in an upright, generally vertical stored position as illustrated by the solid lines in FIG. 1 and rests alongside railing 50 along the side of the deck of a boat. Generally a strap or clip, not shown, or some similar device is used to hold ladder 10 in place so that it doesn't accidentally fall over. In this stored position, roll pin 30 near the end of leg 11 rests in slots 24 of bracket 18A while the lower end of leg 12 is pivotably and swivably affixed to bracket 14, as described earlier. Usually ladder 10, along with brackets 14, 18A and 18B, is located on the side of the boat that has an opening 51 in the boat railing which is normally used for entering and exiting the boat. To use the ladder, the strap or other holding device (if one is used) is loosened, standoff arms 20 (if used) are unfolded and leg 11 is raised so that roll pin 30 clears slot 24. This is the reason that leg mount 37 is rotatably attached to base plate 33 in bracket 14, as described earlier with reference to FIG. 7. The short distance that ladder leg 11 has to be raised to clear slot 24 is accommodated by allowing leg mount 37 to rotate, as described, with respect to its bracket 14. It is quite possible that because of the dimensions, spacings, tolerances and the nature of the materials used in the ladder, e.g., hollow aluminum tubing which has some degree of flex, leg mount 37 may be rigidly attached to base plate 33 and yet allow leg 11 to be raised sufficiently to disengage from and engage with slots 24 in brackets 18A and 18B without damaging the ladder or bracket 14.

After leg 11 is disengaged or unhooked from bracket 18A and while the ladder is still substantially vertical and upright, leg 11 is swung outwardly in an arc of about 180 degrees while leg 12 swivels with respect to bracket 14, as described earlier, to bring leg 11 around to bracket 18B. Roll pin 30 is then slipped into slots 24 of bracket 18B so that the ladder 10 is then resting upright generally vertically at opening 51. Ladder 10 is then swung (or is allowed to swing) outward and downward in a vertical arc about brackets 18B and 14 by virtue of the pivotable engagement of leg 11 in slots 24 of bracket 18B and the pivotable engagement of leg 12 via pin or screw 40 in bracket 14. The ladder is swung downward about 180 degrees into or at least toward the water so that it can be used to climb into or out of the boat. In the case of a pontoon boat, the standoff arms 20 are located and dimensioned so that their distal ends rest against the logs or floats 16 under the boat deck to provide support for the ladder and to space the ladder away from the floats.

When the ladder is no longer needed, it is swung vertically upward until generally in a vertical upright position at opening 51 in the boat railing then leg 11 is lifted to disengage from bracket 18B and is swung outward until it reaches bracket 18A where it is again hooked into place and secured with a strap or clip, or the like, against boat railing 50 in the vertically upright stored position.

I claim:

1. A boat ladder and attachment for the side of a boat, comprising:

a boat ladder comprising a pair of parallel spaced-apart elongated rigid legs having corresponding first and second ends and a plurality of parallel, spaced-apart rungs attached at each end to opposite legs;

first bracket means for attachment to a side of a boat;

means for swivably attaching a first end of one of said boat ladder legs to said first bracket means such that said ladder can be swung while upright in a horizontal semi-circular arc outward from the side of the boat;

means for pivotally attaching said first end of said one boat ladder leg to said first bracket means such that said ladder can be swung in a vertical semi-circular arc outward from the same side of the boat between an upright and a lowered position;

second and third bracket means for attachment to the same side of the boat, one of said second and third bracket means attached forward of said first bracket means the other of said second and third bracket means attached aft of said first bracket means;

each of said second and third bracket means having means for releasably hooking a first end of the other of said boat ladder legs to hold said ladder leg when said ladder is being swung between and is in an upright and a lowered position at the side of the boat.

2. The boat ladder and attachment as described in claim 1 wherein said second and third bracket means are identical to one another.

3. The boat ladder and attachment as described in claim 2 wherein said means for releasably hooking the ladder leg to said second and third bracket means comprises:

a base plate for attachment to the side of the boat;

rigid arm means attached to and extending outboard from said base plate, said arm means containing elongated slot means open at the top end and closed at the lower end;

said other boat ladder leg having pin means for removably engaging said slot means.

4. The boat ladder and attachment as described in claim 1 wherein said first leg of the ladder is a hollow tube and said means for swivably attaching the first end of the first leg of the ladder comprises:

a rigid cylindrical member having an outer annular groove, said member inserted into said first end of said first leg of the ladder so that said groove is inside said leg and one end of said member extends out of said first end of the ladder leg, the interior of said leg having an inwardly extending annular depression rotatably engaging said groove; and means for pivotably attaching said one end of said cylindrical member to said first bracket means.

* * * *. *